United States Patent [19]

Barkan et al.

[11] 4,025,886

[45] May 24, 1977

[54] ELECTRIC CIRCUIT BREAKER WITH ELECTRO-MAGNETICALLY-ASSISTED CLOSING MEANS

[75] Inventors: Philip Barkan, Media; William Thomas Sharp, Philadelphia, both of Pa.

[73] Assignee: General Electric Company, Philadelphia, Pa.

[22] Filed: June 4, 1976

[21] Appl. No.: 693,060

[52] U.S. Cl. ..... 335/195; 335/147

[51] Int. Cl.[2] ..... H01H 3/42

[58] Field of Search ..... 335/195, 147, 16

[56] References Cited

UNITED STATES PATENTS

| | | | |
|---|---|---|---|
| 3,366,900 | 1/1968 | Barkan | 335/15 |
| 3,663,906 | 5/1972 | Barkan et al. | 335/195 |
| 3,777,291 | 12/1973 | Kroon | 335/16 |

*Primary Examiner*—Harold Broome
*Attorney, Agent, or Firm*—William Freedman

[57] ABSTRACT

This electric circuit breaker contains electromagnetic-assist means for opposing the contact-repulsion forces developed when a high current flows through the breaker. The assist means comprises a rigid supporting member which can be restrained in a fixed position to render the assist means capable of transmitting closing force to the movable contact of the breaker but which supporting member is releasable to render said assist means generally ineffective to transmit closing force to said movable contact. The assist means further comprises a toggle connected between the supporting member and the movable contact for imparting a closing force to the movable contact when forced toward an in-line position while said supporting member is restrained.

For forcing the toggle toward its in-line position, there is provided magnetic structure cooperating with a conductor connected in series with the circuit breaker contacts. This magnetic structure comprises a movable armature that is driven with a force varying directly with current through said conductor. A linkage interconnects this armature and the toggle to force the toggle toward its in-line position in response to the armature's being driven by said force.

7 Claims, 5 Drawing Figures

ELECTRIC CIRCUIT BREAKER WITH ELECTRO-MAGNETICALLY-ASSISTED CLOSING MEANS

BACKGROUND

This invention relates to an electric circuit breaker that includes electromagnetic means for opposing the magnetic contact-repulsion forces developed when a high current flows through the circuit breaker. This type of circuit breaker is referred to hereinafter as a circuit breaker with electromagnetically -assisted closing means.

A circuit breaker with electromagnetically-assisted closing means is disclosed and claimed in U. S. Pat. No. 3,663,906-Barkan et al. assigned to the assignee of the present invention, and the present application discloses and claims an improvement thereof. The circuit breaker of the Barkan et al patent comprises a first contact and a second contact movable into engagement with said first contact to close the circuit breaker and movable out of engagement with said first contact to open the circuit breaker. Electromagnetic-assist means develops a magnetic closing force on the movable contact which varies directly in accordance with the current through the contacts. This assist means of the patent comprises conductive means in series with said contacts for carrying the inter-contact current through a loop-shaped path that comprises a pair of series-connected arms between which a repulsive magnetic force is developed that urges the arms apart when the current traverses said loop-shaped path. A toggle is provided for converting this repulsive force into said magnetic closing force on the movable contact. In so converting the repulsive force, the toggle also amplifies this force to provide a closing force substantially higher than the repulsive force.

The above-described arms of the loop-shaped circuit of the Barkan et al patent and the conductor section joining them are made of flexible conductive braids. A disadvantage of this construction is that in a high current application, e.g., one subject to steady state currents of 2,000 amperes or more, the volume of the braid required to carry the high current is so great as to make it very difficult to permit a reasonable size loop to be formed in the loop-shaped conductive path. Also, one of the heafy conductive arms in such a construction is required to move with the movable contact rod, and this detracts from the desired low mass of the moving contact structure.

SUMMARY

An object of our invention is to provide magnetic-assist means that does not require th above-described loop-shaped current path and does not require that one of the heavy conductive arms of any such loop be movable with the movable contact structure.

Another object is to provide magnetic-assist means that readily lends itself to use with a circuit breaker that includes a conductor of simple configuration carrying current to and from the movable contact rod.

Still another object is to derive force magnification not only from toggle action, as in the Barkan et al patent, but also from another source so as to supplement the toggle action. This allows the toggle linkage to operate further away from an in-line position, thus rendering the design less critical to adjustment and more tolerant of contact-erosion without readjustment.

In carrying out the invention in one form, we provide electromagnetic-assist means comprising a substantially rigid supporting member restrainable in a fixed position to render said assist means capable of transmitting closing force to said movable contact and releasable to render said asist means generally ineffective to transmit closing force to said movable contact. Releasable latching means is provided for normally restraining said supporting member in said fixed position when the contacts are engaged. A toggle, which has one end coupled to said supporting member and its opposite end coupled to the movable contact of the breaker, acts to impart a closing force to the movable contact when forced toward an in-line position.

A conductor in series with the contacts of the breaker carries current to and from the contacts. A member of magnetizable material forms a part of the magnetic circuit for flux generated by current through the conductor. A movable armature is attracted to said magnetizable member with a force varying directly with current through said conductor. A linkage interconnects said armature and said toggle for forcing the toggle toward its in-line position in response to the armature's being attracted toward said magnetizable member.

During an opening operation the aforesaid latching means is released prior to disengagment of the contacts, thus disabling the electromagnetic-assist means at an early stage in the opening operation.

BRIEF DESCRIPTION OF DRAWINGS

For a better understanding of the invention, reference may be had to the following drawings, wherein.

Figure 1:
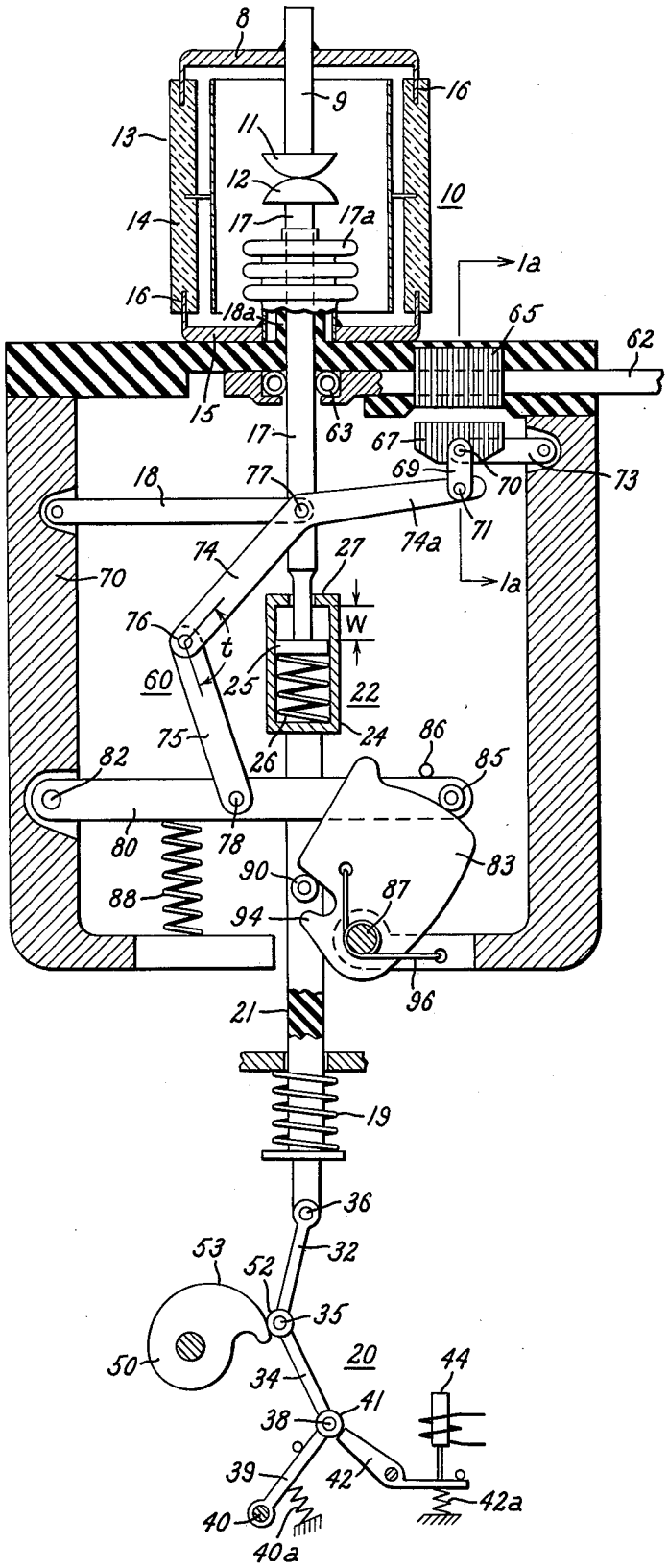
FIG. 1 is a side elevational view of a circuit breaker embodying one form of our invention. The circuit breaker is shown in its fully-closed position.

FIG. l*a* is an enlarged sectional view taken along the line 1a-1a of FIG. 1.

Figure 2:
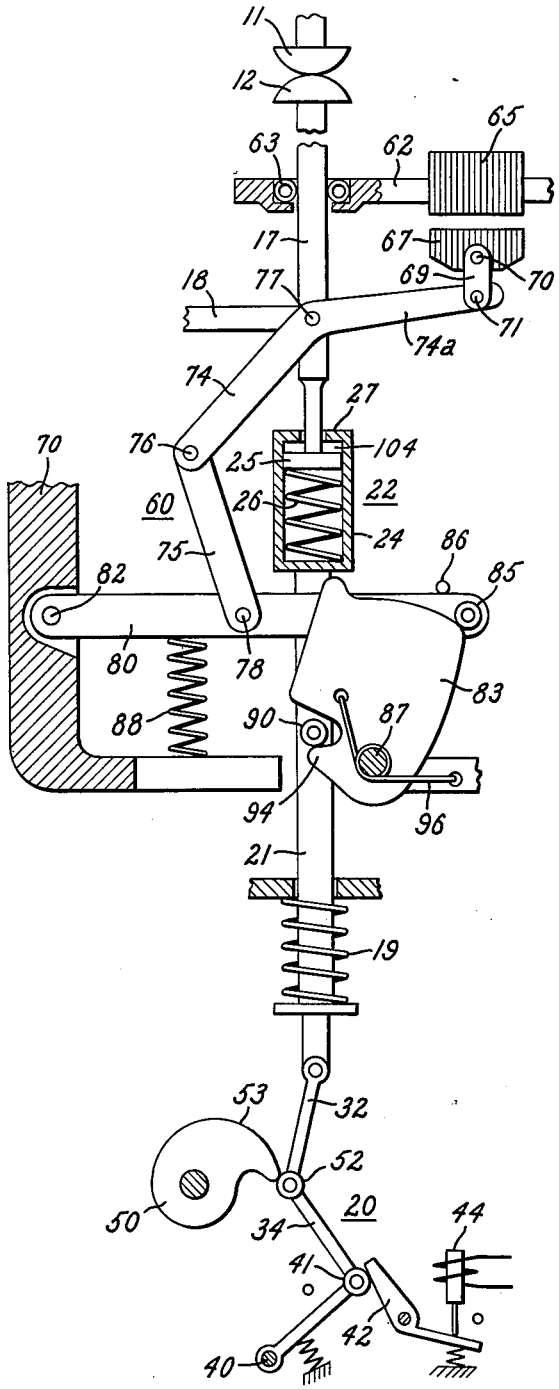

FIG. 2 shows the circuit breaker of FIG. 1 in an intermediate position through which it passes during an opening operation.

Figure 3:
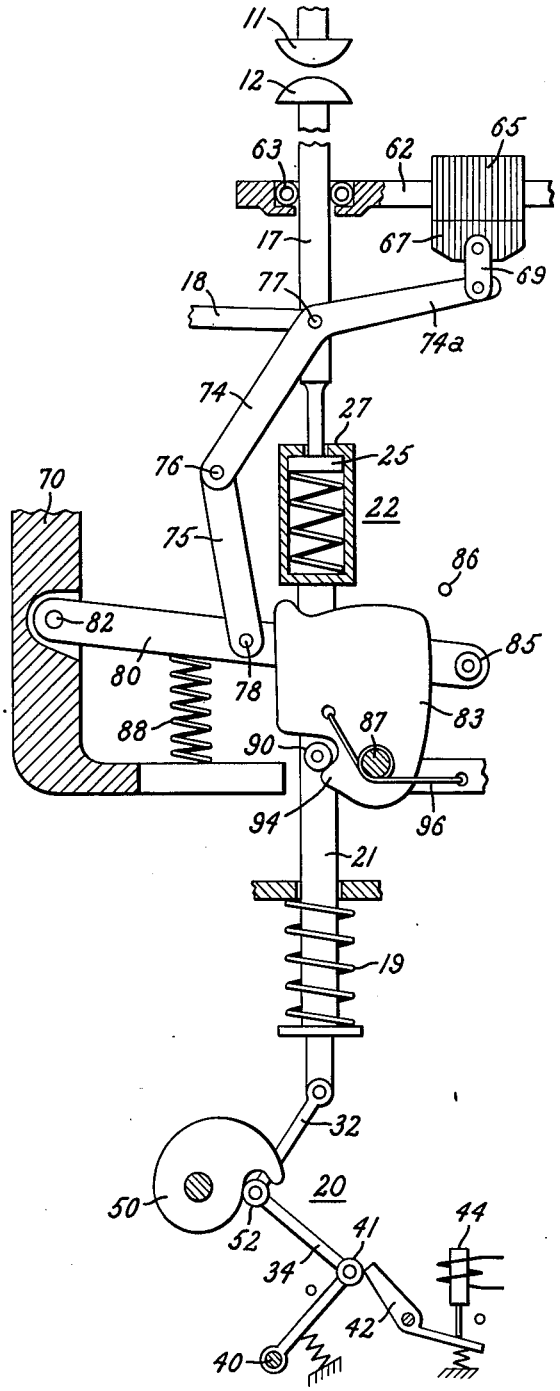

FIG. 3 shows the breaker of FIG. 1 in another intermediate position through which it passes at a later stage of an opening operation.

Figure 4:
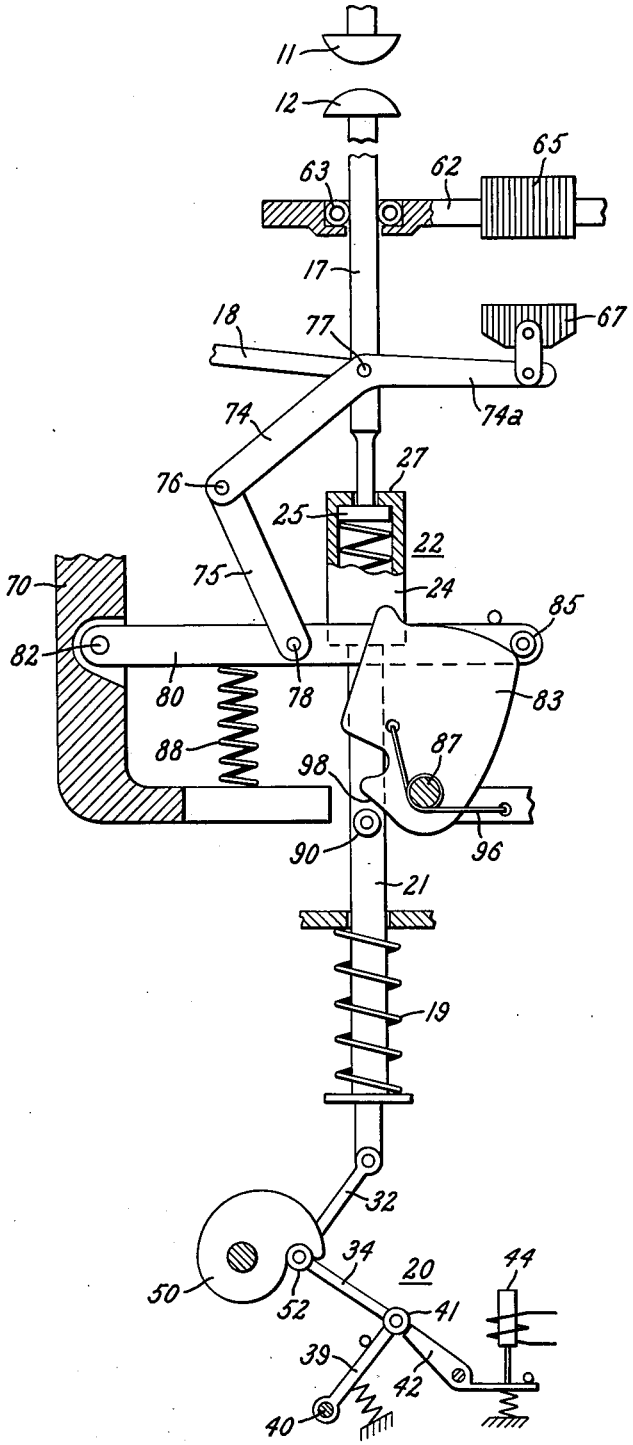

FIG. 4 shows the circuit breker of FIG. 1 in its fully open position.

DETAILED DESCRIPTION OF PREFERRED EMBODIMENT

CIRCUIT INTERRUPTER 10

Referring now to FIG. 1, there is shown a circuit interrupter 10 comprising a pair of separable contacts 11 and 12. Contact 11 is a stationary contact, and contact 12 is a movable contact that is vertically movable into and out of engagement with the stationary contact. In FIG. 1, the circuit breaker is shown in its fully closed position where contact 12 engages contact 11. Opening of the circuit breaker is effected by driving contact 12 from its position of FIG. 1 downwardly through its intermediate position of FIG. 3 into its fully open position of FIG. 4. Closing is effected by returning contact 12 from its position of FIG. 4 to its position of FIG. 1.

Although this invention, in its broader aspects, is applicable to several different types of circuit breakers, we have shown it embodied in a circuit breaker of the vacuum type. Accordingly, the contacts 11 and 12 are shown located inside a highly evacuated envelope 13 comprising a cylindrical insulated casing 14 and upper and lower end caps 8 and 15 respectively joined thereto by vacuum-tight seals 16. Stationary contact 11 is mounted on a stationary conductive contact rod 9 that is integrally joined to the upper end cap 8. Movable contact 12 is mounted on a movable conductive contact rod 17 that projects freely through lower end cap 15. A flexible metallic bellows 17a permits vertical movement of rod 17 without impairing the vacuum inside envelope 13.

The interrupter is mounted on a stationary frame 70 to which the lower end plate 15 is suitably attached. A suitable guide link 18 is pivotally connected at one end to the frame 70 and at its other end to the contact rod 17. This guide link coacts with a suitable slide bearing 18a to confine motion of the contact rod 17 to a substantially straight-line vertical path.

OPERATING MECHANISM 20, 21, 22 FOR INTERRUPTER

For driving the movable contact 12 upwardly from its fully open position of FIG. 4 into its fully closed position of FIG. 1, we provide a mechanically trip-free closing mechanism 20 of a suitable conventional form. The closing mechanism 20 is coupled to the movable contact rod 17 by means of an operating rod 21 of insulating material and a wipe device 22 of conventional form located between operating rod 21 and contact rod 17. Closing is effected by causing the mechanism 20 to drive operatng rod 21 upwardly from its position of FIG. 4 into its position of FIG. 1 in a conventional manner soon to be described. Opening, on the other hand, is effected by driving the operating rod 21 downwardly from its position of FIG. 1 by means of an opening spring 19 in a manner soon to be described.

The above-mentioned wipe device 22 comprises a driving part in the form of a cylindrical carriage 24 coupled to operating rod 21 and a driven part in the form of a piston 25 coupled to contact rod 17 and slidably mounted within the bore of cylindrical carriage 24. Also disposed within the bore of carriage 24 is a precompresed wipe spring 26 which urges piston 25 upwardly toward engagement with an annular stop 27 on the carriage. When carriage 24 is driven in an upward direction from its position of FIG. 4, piston 25 also moves upwardly, carrying movable contact 12 toward stationary contact 11. During this closing strike, precompressed spring 26 holds piston 25 in engagement with annular stop 27 until movable contact 12 engages stationary contact 11. This engagement between the contacts terminates upward motion of contact 12 and piston 25, but carriage 24 continues moving upwardly, further compressing spring 26 and separating stop 27 from piston 25 until upward motion of carriage 24 is finally terminated. The distance W moved by the carriage as it travels upwardly after the contacts engage is referred to hereinafter as "wipe" or "wipe-travel."This wipe-travel serves to provide a force that helps to hold the contacts in engagement after closing despite limited wear of the contacts that might have previously occurred. Thus, even if the contacts engage at a slightly later point in the closing stroke because of such contact wear, there will still be some wipe travel after contact engagement; and this will act to make available for holding the contacts closed the force stored in wipe spring 26 and any additional force produced by further compression of the spring during wipe.

Wipe device 22 functions during an opening operation to permit operating rod 21 to move downwardly through the entire wipe distance W while the contacts still remain in engagement. When this wipe travel has been exhausted, stop 27 strikes piston 25 and carries contact rod 17 downwardly with operating rod 21.

The closing mechanism 20 comprises a pair of toggle links 32 and 34 pivotally joined together at a knee 35. One of the toggle links 32 is pivotally connected at its opposite end to the lower end of operating rod 21 by means of a pivot pin 36. The other toggle link 34 is pivotally connected by pivot pin 38 to the upper end of a guide link 39. Guide link 39 is pivotally supported at its lower end on a fixed fulcrum 40 and is biased toward its position of FIG. 1 by a suitable reset spring 40*a*. The pivot pin 38 carries a latch roller 41 which cooperates with a suitable trip latch 42, which is normally held in its reset position of FIG. 1 by a reset spring 42*a*. Trip latch 42 is arranged to be operated in response to predetermined circuit conditions by means of a suitable conventional tripping solenoid 44. Typically, the tripping solenoid 44 is suitably connected to be operated in response to an overcurrent through the power circuit trough the breaker. After the solenoid is is deenergized, reset spring 42*a* returns latch 42 to its reset position, shown in FIG. 4.

So long as trip latch 42 remains set, i.e., in its latching position of FIG. 4, and the guide link 39 is latched by the trip latch, as in FIG. 4, toggle 32, 34 is capable of transmitting thrust to movable operating rod 21. Thus, when knee 35 is driven to the right from its position of FIG. 4, toggle 32, 34 is extended and drives operating rod 21 upwardly against the bias of opening spring 19. FIG. 1 illustrates the position of the parts after knee 35 has been moved to the right to effect complete circuit-breaker closing. This closing motion of knee 35 from its position of FIG. 4 to its position of FIG. 1 is produced by the action of a rotable cam 50 cooperating with the usual roller 52 which is mounted at knee 35. When cam 50 is rotated counterclockwise from its position of FIG. 4 to its position of FIG. 1 by a suitable operator (not shown), it drives knee 35 to the right, thereby extending 32, 34 32,34 and driving operating rod 21 and contact 17 through their upward closing stroke. At the end of a closing operation, a constant radius portion 53 of cam 50 holds the toggle 32, 34 in its extended position of FIG. 1 and prevents the goggle from collapsing at its knee 35 so long as trip latch 42 remains in latched position.

Opening of the circuit breaker is effected by tripping latch 42. This renders the closing mechanism 20 incapable of transmitting continued closing thrust to operating rod 21. Accordingly, the opening spring 19 quickly discharges to drive operating rod 21 downwardly from its position of FIG. 1 through its position of FIGS. 2 and 3 into its position of FIG. 4. This motion carries the contact rod 17 downwardly through an opening stroke. The guide link 39 is forced in a clockwise direction about its stationary pivot 40 by such opening motion; but at the end of the opening stroke, when toggle 32, 34 has collapsed, reset spring 40*a* returns the guide link to its reset position of FIG. 4, where it is relatched by latch 42.

Returning now to a closing operation, near the end of the upward closing stroke of movable contact 12, current will begin flowing through contacts 11, 12 via a path extending through conductive parts 9, 11, 12 and 17. As pointed out hereinabove, this current produces a magnetic force opposing closing that varies in magnitude directly in accordance with the square of the current. If only a low current flows, then closing mechanism 20 acting alone can provide sufficient force to complete the closing operation against this minor opposition and to maintain contacts 12 and 11 in engagement. But if the current is a high current, then much higher closing forces are needed to complete the closing operation and to maintain the contacts engaged. For providing this supplemental closing force, we rely, in one form of our invention, upon electromagnetic-assist means 60.

ELECTROMAGNETIC-ASSIST MEANS 60

The electromagnetic-assist means 60 comprises a conductive bus bar 62 electrically connected in series with the contacts 11, 12 and extending transversely of movable contact rod 17. This bus bar is a stationary member fixedly mounted on the stationary frame 70 and containing an aperture surrounding the movable contact rod 17. Suitable slide contact 63 within the aperture provide an electrical connection between the stationary bus bar 62 and movable contact rod 17. These slide contacts may be of any suitable conventional form, e.g., such as that shown in U.S. Pat. No. 3,087,038-Bethke.

Figure 1A:
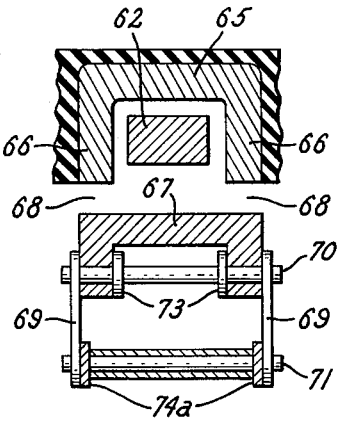

The electromagnetic-assist means further comprises a U-shaped member 65 of low-retentivity magnetic material, such as soft iron, suitably fixed to the frame 70. As shown in FIG. 1*a*, this U-shaped member 65 comprises two spaced apart legs 66 and contains a recess between the legs in which the bus bar 62 is located. The U-shaped member 65 forms a portion of a magnetic circuit for flux surrounding the bus bar that is generated by current through the bus bar. Adjacent the pole faces of the U-shaped member 65 is an armature 67, also of soft iron, extending between the legs 66. In FIG. 1a, the armature is shown spaced from the pole faces by air gaps 68. The magnetic circuit for flux surrounding the conductor 62 extend through the U-shaped member 65 and the armature 67 across the air gaps 68. In a well known manner, the armature 67 is attracted to the U-shaped member 65 with a magnetic force that varies directly with the square of the current through conductor 62, assuming no saturation of the iron.

In order to reduce eddy current heating of the U-shaped member 65 and armature 67, these parts are suitably laminated, with the laminations extending parallel to the plane of FIG. 1*a*. These laminations, by reducing eddy currents, also keep the magnetic forces developed by this magnetic structure more in phase with the current through conductor 62.

The armature 67 is pivotally connected to an extension 74*a* of a toggle link 74, soon to be described, by means of a connecting link 69 and two pivots 72 and 71 at opposite ends of the connecting link. When the armature 67 is attracted toward the U-shaped member 65, a force is exerted on the extension 74*a* of toggle link 74, urging the extension in an upward direction, as seen in FIGS. 1 and 1*a*. The armature 67 is guided for substantially straight-line vertical motion by suitable guide means, such as a guide link 73 shown in FIG. 1.

The electromagnetic-assist means 60 further comprises a toggle comprising two toggle links 74 and 75 pivotally joined together at a knee 76. Upper toggle link 74 has its upper end pivotally connected to contact rod 17 by a pivot pin 77. Lower toggle link 75 has its lower end pivotally mounted at 78 on a toggle support lever 80. Toggle support lever 80 has one end pivotally mounted on a fixed pivot 82 carried by frame 70. The opposite, or free, end of toggle support lever 80 is restrained in its position of FIG. 1 by a releasable latch 83 that cooperates with a latch roller 85 carried by lever 80. A suitable stop 86 prevents counterclockwise motion of lever 80 past its position of FIG. 1. The latch 83, which is pivoted on a stationary pivot 87 carried by frame 70, will soon be described in more detail.

Returning now to the magnetizable members 65 and 67, when the armature 67 is attracted toward the stationary U-shaped member 65, the upward force exerted on the extension 74*a* of toggle link 74 tends to pivot the toggle link 74 in a counterclockwise direction about its pivot 77 of FIG. 1, thus urging the toggle 74, 75 toward its in-line position. When the toggle 74, 75 is urged toward its in-line position, it exerts, through toggle action, an upward closing force at pivot 77 on the movable contact rod 17. This upward closing force on contact rod 17 opposes the previously-described contact-separating forces tending to drive the contacts apart, thus preventing the contacts from unintentionally separating when high currents flow therethrough.

An additional upward force is present on the contact rod 17 to supplement the upward force that is derived from the toggle action of the immediately-preceding paragraph. This additional upward force is derived from the direct reaction between magnetic parts 65 and 67. This direct reaction produces an upward force on armature 67 and , hence, on toggle extension 74*a*. This, in turn, by virtue of the laws of statics, produces an upward force acting on contact rod 17 since the toggle extension 74*a* is pinned directly to the contact rod. It will be apparent that this aditional upward force is derived in a way that is different and distinct from the previously-described toggle action.

As a result of these two combined effects, a large total upward reaction force on the contact rod 17 can be achieved. Typicaly, if the toggle action magnification is approximately 3, which is a conservative figure for a toggle, and the direct amplification of force is an additional factor of one, there is produced an upward reaction force on contact rod 17 which is 4 times the magnitude of the magnetic force generated between armature 67 and stationary magnet 65. As a result, the magnetic-assist device does not require a very large magnet and can perform effectively with a relatively moderate toggle angle *t* (FIG. 1). This smaller toggle angle means that the design is more tolerant of variations, such as those produced by contact erosion, and therefore will need little or no readjustment to compensate for contact-erosion.

It should also be noted that the effect of contacterosion is to cause the toggle to be driven further toward its in-line position, thereby increasing the magnitude of the hold-closed forces which are generated. In this sense, the unit is fail-safe, and failure to readjust will actually lead to higher than required hold-closed forces. This feature also means that the maximum hold-closed force will be developed in the fully-closed position of the contacts, which is where it is most needed.

It should be noted that our magnetic assist means does not require any massive loop-shaped conductor, as in the aforesaid Barkan et al patent. The conductor 62 carrying current to and from the movable contact rod 17 is a simple bar extending transversely of the contact rod. Of course, suitable current-transfer means, such as slide contacts 63, are needed to carry current between these parts 17, 62.

It is noteworthy that both the contact-separating magnetic force and the magnetic-assist force vary as the square of the current. Since the design is such that the magnetic-asist force is greater than the contact-separating force, the magnetic-assist force automatically stays above the contact-separating force irrespective of the extent that the current rises, asuming, of course, that the magnetic-assist means is not in its disabled condition described hereinafter. Although this is a preferred relationship, it is only necessary that the sum of the wipe spring force and the magnetic-assist force exceed the contact-separating force at all currents within the rating of the breaker.

DISABLING THE ELECTROMAGNETIC-ASSIST MEANS 60

Not infrequently, the circuit breaker will be called upon to open while high currents are flowing therethrough. To prevent interference with such opening by the closing force developed by the magnetic-assist means 60 during such high current conditions, we provide means for effectively disabling the magnetic-asist means 60 during this period. This disabling means comprises the releasable latch 83 and means responsive to opening movement of operating rod 21 for releasing latch 83 to free the toggle-support lever 80 for clockwise motion about its pivot 82. When toggle support lever 80 is thus free, the toggle 74, 75 is no longer capable of imparting substantial closing force to contact rod 17. Thus, the hold-closed force derived from the above-described toggle action is effectively eliminated during opening.

The previously-described hold-closed force on contact rod 17 derived from the direct reaction between magnetic parts 67 and 65 is effectively eliminated during this period by virtue of the fact that the armature 67 moves upwardly into engagement with the U-shaped member 65, as shown in FIG. 3, immediately after the toggle-support lever 80 is released by latch 83. Such engagement between parts 67 and 65 terminates the applicaton of upward force from the magnetic structure on toggle extension 74*a*, thereby allowing the toggle link 74 to pivot about the pivot 72 acting as a fixed point while the contact rod 17 moves downwardly during opening. It will thus be apparent that the magnetic action of the magnetic-assist means 60 does not in any significant way impair normal opening of the contacts. The pole faces at the lower end of the legs 66 may be thought of as a stop against which the armature 67 is moved during the action described in this paragraph.

FIG. 3 illustrates the behavior of the magnetic-assist means 60 during this period when it is disabled. In FIG. 3, latch 83 i shown released, and the toggle support lever 80 is moving in a downward, or clockwise, direction against the action of a relatively weak reset srping 88. When latch 83 has been released, the opposition of the magnetic-assist means 60 to opening can be no greater than that offered by relatively weak reset spring 88. With only this minor opposition to overcome, opening can take place at the desired high speed.

For controlling the latch 83 of magnetic-assist means 60 in response to motion of operating rod 21, a pin 90 is provided on the operating rod for cooperating with the latch 83. When the circuit breaker is in its closed position of FIG. 1, pin 90 is located in an enlarged notch 92 in latch 83. During circuit-breaker opening, when the operating rod is driven downwardly by opening spring 19, pin 90 engages a projecting nose 94 on latch 83 and drives latch 83 counterclockwise about its pivot 87. FIG. 2 shows the parts after the downward moving pin 90 has driven latch 83 counterclockwise to the point at which the latch is just ready to release the toggle-support lever 80. When pin 90 passes downwardly through the position of FIG. 2, the counterclockwise moving latch 83 releases the toggle support lever 80, and lever 80 moves clockwise toward its position of FIG. 3, driven by the magnetic force on armature 67 and contact 12 and the opening force on contact rod 17 applied by opening spring 19. Downwardly moving pin 90 eventually moves past the nose 94, at which time latch 83 resets to its position of FIG. 4 under the influence of a latch-reset spring 96. Latch-reset spring 96 is so constructed that it returns the latch in a clockwise direction to a neutral position just short of where it would be effective to latch the togglesupport lever 80. When current through the circuit breaker is interrupted, the toggle-support lever 80 returns to its position shown in FIG. 4 under the influence of reset spring 88. Lever 80 is not latched in this position, however, since latch 83 is then being held by its spring 96 in the above-described neutral position where it is ineffective to latch lever 80.

It is desirable that lever 80 remain unlatched when the circuit breaker is fully open because this retains the magnetic-assist means 60 in a disabled condition and thus prevents an inadvertent closing of the circuit breaker in response to any electrical breakdown between the contacts 11, 12 which might result in a resumption of current through the circuit breaker.

When the circuit breker is near its fully-open position and the current therethrough is interrupted, armature 67 can drop away from the U-shaped member 65, as shown in FIG. 4, and the reset spring 88 acting on toggle support lever 80 will drive the support lever upwardly into its position of FIG. 4.

RESETTING THE MAGNETIC-ASSIST MEANS DURING CLOSING

As prevously pointed out, a closing operation is performed by driving closing cam 50 counterclockwise from its position of FIG. 4 into its position of FIG. 1, thereby extending toggle 32, 34 of the closing mechanism 20 and driving operating rod 21 upwardly. After operating rod 21 has traveled through a predetermined part of the closing stroke, pin 90 on the upwardly moving operating rod engages the lower surface 98 of nose 94 on latch 83, thereby pivoting latch 83 clockwise from its position of FIG. 4 to force the latch into a latching position beneath roller 85 on toggle-support lever 80. (A projecting tip 93 on the latch 83 prevents the latch from overtraveling in a clockwise direction in response to impact from the upwardly moving pin 90). During the remainder of the closing travel of operating rod 21, pin 90 holds latch 83 in latching relationship with the roller 85 on the toggle support lever. The position of these parts at the end of a closing stroke is illustrated in FIG. 1. During the above-described upward closing travel of operating rod 21, pin 90 moves upwardly past nose 94, causing latch-reset spring 96 to pivot latch 83 counterclockwise; but pin 90, which is then positioned in notch 92, limits such counterclockwie motion of latch 83 sufficiently to maintain the latch in latching relationship with roller 85 on toggle support lever 80.

During a closing operation, it is important that the latch 83 be restored to its latching position prior to the instant at which current flow through the contacts is reinitiated. This can be accomplished if the latch is restored to its latching position prior to the point of contact engagement, with a slight margin allowed for a possible restrike between the contacts when they are close together just prior to reaching engagement. The reason for this timing is that unless the latch is reset, the magnetic- assist means 60 remains disabled and therefoe unavailable to provide the supplemental force that would be needed under high current conditions for closing against the magnetic opposing force developed as soon as current flow is resumed. But with the latch reset before the point at which current flow is resumed, the magnetic-assist means 60 is available to supply the required supplemental closing force as soon as current flow is resumed.

TIMING THE DISABLEMENT OF THE MAGNETIC ASSIST MEANS DURING OPENING

During the opening stroke, it is important that the latch 83 be released prior to he point at which the contacts part. Otherwise the magnetic-assist means 60 would be developing a hold-closed force at the time of attempted contactpart that could defeat, or detract from he speed of, contact separation. By releasing the latch 83 prior to the point of contact-part, we render the magnetic-assist means 60 incapable of supplying a substantial closing force at the time the contacts separate, thus allowing the contacts to separate without substantial interference from the magnetic-assist means 60. For achieving this timing, we make latch-release responsive to motion of the operating rod 21. Since the operating rod 21 moves through its wipe travel prior to contact separation, we can use this motion to trip latch 83 before the point of contact part is reached. FIG. 2 best illustrates this relationship, showing how downwrd opening motion of the operating rod 21 is in the act of releasing latch 83 while some wipe travel at 104 is still needed before the contacts will part.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. An electric circuit breaker comprising:

a. a first contact, b. a second contact movable into engagement with said first contact to close said circuit breaker and movable out of engagement with said first contact to open the circuit breaker and interrupt the circuit therethrough, c. an operating member for transmitting opening and closing forces to said movable contact, d. electromagnetic-assist means for developing a magnetic closing force on said movable contact which varies directly in accordance with the current through said contacts, said electromagnetic-assist means comprising:

d1. a substantially rigid supporting member restrainable in a fixed position to render said electromagnetic-assist means capable of transmitting closing force to said movable contact and releasable to render said electromagnetic-assist means generally ineffective to transmit closing force to said movable contact, d2. releasable latching means for normally restraining said supporting member in said fixed position when said contacts are engaged, d3. a toggle having one end coupled to said supporting member and its opposite end coupled to said movable contact independently of said operating member, said toggle imparting a closing force to said movable contact when forced toward an in-line position while said supporting member is restrained in said fixed position, d4. a conductor in series with said contacts for carrying current to and from said contacts, d5. a member of magnetizable material forming a portion of a magnetic circuit for flux generated by current flowing through said conductor, d6. a movable armature that is attracted to said magnetizable member with a force varying directly with current through said conductor, and d7. a linkage interconnecting said armature and said toggle for forcing said toggle toward an in-line position in response to said armature's being attracted toward said magnetizable member, e. a wipe mechanism coupling together said operating member and said movable contact and permitting limited overtravel in a closing direction of said operating member after said contacts engage during a closing operation and also permitting limited travel of said operating member in an opening direction before opening force is transmitted from said operating member to said movable contact, f. and releasing means responsive to travel of said operating member in an opening direction for releasing said latching means prior to disengagement of said contacts during an opening operation.

2. A circuit breaker as defined in claim 1 and further comprising restoring means operable following separation of said contacts and completion of an interrupting operation for restoring said latching means to restraining relationship with said supporting member before said contacts engage during a subsequent closing operation.

3. The circuit breaker of claim 1 in which said linkage of (d7), when subjected to the force of attraction between said armature and said magnetizable member while said supporting member is restrained in said fixed position, applied to said movable contact an additional hold-closed force that is separate and distinct from the hold-closed force produced by the toggle action resulting from forcing said toggle toward an in-line position, thus supplementing said toggle action in producing hold-closed force.

4. The circuit breaker of claim 3 in combination with a stop fixed with respect to said magnetizable member against which said armature is moved by said force of attraction immediately after said latching means is released, thus terminating said additional hold-closed force.

5. The circuit breaker of claim 1 in which:

a. said toggle comprises a pair of links, means pivotally interconnecting adjacent portions of said links to form a toggle knee, means pivotally connecting a portion of one said links spaced from said knee to said supporting member, and means pivotally connecting a portion of the other of said links spaced from said knee to said movable contact, b. a said other link includes an extension constituting a portion of said linkage of (d7) of claim 1, and c. the magnetic attraction between said armature and said magnetizable member applies through said extension a supplemental hold-closed force to said movable contact when said supporting member is restrained in said fixed position.

6. The circuit breaker of claim 1 in which said member of (d5) is a generally U-shaped structure that partially surrounds said conductor and is fixed with respect to said conductor.

7. The circuit breaker of claim 1 in which said movable contact is carried by a conductive movable contact rod located electrically between said movable contact and said conductor, and said conductor is a stationary bar extending transversely of said rod into the immediate vicinity of said rod.

* * * * *